US009455485B2

(12) United States Patent
Yamada

(10) Patent No.: US 9,455,485 B2
(45) Date of Patent: Sep. 27, 2016

(54) NON-RECIPROCAL CIRCUIT ELEMENT, MODULE OF THE SAME, AND TRANSMISSION AND RECEPTION MODULE

(71) Applicant: Murata Manufacturing Co., Ltd., Nagaokakyo-shi, Kyoto-fu (JP)

(72) Inventor: Yoshiki Yamada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 168 days.

(21) Appl. No.: 14/474,341

(22) Filed: Sep. 2, 2014

(65) Prior Publication Data

US 2015/0109066 A1 Apr. 23, 2015

(30) Foreign Application Priority Data

Oct. 23, 2013 (JP) ..... 2013-220181

(51) Int. Cl.
*H01P 1/36* (2006.01)
*H01P 1/383* (2006.01)
*H01P 1/387* (2006.01)

(52) U.S. Cl.
CPC ..... *H01P 1/36* (2013.01); *H01P 1/383* (2013.01); *H01P 1/387* (2013.01)

(58) Field of Classification Search
CPC ..... H01P 1/32; H01P 1/36; H01P 1/38; H01P 1/383
USPC ..... 333/1.1, 24.2
See application file for complete search history.

(56) References Cited

U.S. PATENT DOCUMENTS

2012/0019332 A1* 1/2012 Hino ..... H01P 1/36 333/1.1

FOREIGN PATENT DOCUMENTS

| | | | |
|---|---|---|---|
| JP | 2004-120539 | A | 4/2004 |
| JP | 2005-026898 | A | 1/2005 |
| JP | 2009-206791 | A | 9/2009 |
| JP | 2010-161575 | A | 7/2010 |
| JP | 4508192 | B2 | 7/2010 |

* cited by examiner

*Primary Examiner* — Stephen E Jones
(74) *Attorney, Agent, or Firm* — Keating & Bennett, LLP

(57) ABSTRACT

A non-reciprocal circuit element includes a ferrite to which a direct current magnetic field is applied by a permanent magnet, and first and second center electrodes arranged on the ferrite so as to intersect with and be insulated from each other. One end of the first center electrode is connected to a first port and the other is connected to a second port. One end of the second center electrode is connected to the second port and the other is connected to a ground port. A first capacitor and a resistor connected in parallel are connected between the first and second ports and a second capacitor is connected between the second and ground ports. An input/output terminal of at least one filter is connected between the first or second port and the resistor and the ground terminal thereof is connected to the second or first port.

14 Claims, 12 Drawing Sheets

NON-RECIPROCAL CIRCUIT ELEMENT, MODULE OF THE SAME, AND TRANSMISSION AND RECEPTION MODULE

BACKGROUND OF THE PRESENT INVENTION

1. Field of the present invention

The present invention relates to a non-reciprocal circuit element, in particular, a non-reciprocal circuit element such as an isolator and a circulator, which is preferably for use in a microwave band, a module thereof, and a transmission and reception module including the non-reciprocal circuit element.

2. Description of the Related Art

Hitherto, a non-reciprocal circuit element such as an isolator and a circulator has characteristics such that it transmits signals in the predetermined specific direction only and does not transmit signals in the reverse direction. Using this characteristics, the isolator is used for a transmission circuit unit and a reception circuit unit of a mobile communication device such as a cellular phone, for example.

As the non-reciprocal circuit element (dual port-type isolator) of this type, an isolator as disclosed in Japanese Patent No. 4508192 has been known. The isolator is configured by an equivalent circuit as illustrated in FIG. 18. That is to say, a first center electrode 35 (inductor L1) and a second center electrode 36 (inductor L2) are arranged on the surface of a ferrite 32 so as to intersect with and be insulated from each other. A capacitor C1 and a resistor R that are connected to each other in parallel are connected between one end of the first center electrode 35 connected to an input port P1 and one end of the second center electrode 36 connected to an output port P2. Further, a capacitor C2 is connected in parallel with the second center electrode 36. Note that capacitors Cs1 and Cs2 are capacitors for matching of input and output impedances.

A dual port-side isolator configured by the equivalent circuit has characteristics as illustrated in FIG. 19. A curved line Y1 in FIG. 19 indicates a forward transmission characteristic (insertion loss characteristic) from the input port P1 to the output port P2 and a curved line Y2 indicates a reverse attenuation characteristic (isolation characteristic) from the output port P2 to the input port P1. The insertion loss has a characteristic of being low over a wide band as is obvious from the curved line Y1 but the isolation is achieved in a relatively narrow band as is obvious from the curved line Y2. Due to this, it becomes gradually difficult for the isolator to cope with a wide frequency band and a plurality of frequency bands that are used in mobile communication in recent years.

The isolator of this type is used for the transmission circuit unit. If it can be used for a transmission and reception circuit unit, the circuit configuration can be reduced in size.

SUMMARY OF THE PRESENT INVENTION

Accordingly, preferred embodiments of the present invention provide a non-reciprocal circuit element and a module thereof that provide a preferable isolation characteristic over a wide band and are configured to be used for a transmission and reception circuit unit. In addition, preferred embodiments of the present invention provide a transmission and reception module including one non-reciprocal circuit element.

According to a first aspect of various preferred embodiments of the present invention, a non-reciprocal circuit element includes a permanent magnet, a ferrite to which a direct current magnetic field is applied by the permanent magnet, and a first center electrode and a second center electrode that are arranged on the ferrite so as to intersect with and be insulated from each other. In the non-reciprocal circuit element, one end of the first center electrode is connected to a first port and the other end of the first center electrode is connected to a second port, one end of the second center electrode is connected to the second port and the other end of the second center electrode is connected to a ground port, a first capacitor and a resistor that are connected to each other in parallel are connected between the first port and the second port, a second capacitor is connected between the second port and the ground port, and an input/output terminal of at least one filter is connected between the first port or the second port and the resistor and a ground terminal of the filter is connected to the second port or the first port.

According to a second aspect of various preferred embodiments of the present invention, there is provided a non-reciprocal circuit element module in which the non-reciprocal circuit element is mounted on a substrate.

According to a third aspect of various preferred embodiments of the present invention, there is provided a transmission and reception module in which the non-reciprocal circuit element including a filter transmitting a transmission signal and attenuating a receiving band signal and a branch circuit element branching the transmission signal and a reception signal are mounted on a substrate.

In the non-reciprocal circuit element, a wideband forward transmission characteristic with low loss is achieved while a wideband reverse characteristic is tried to be achieved by using a wideband filter. This provides a non-reciprocal circuit element capable of being used for a wideband or multiband transmission circuit unit having a wide operating band.

Further, the non-reciprocal circuit element includes the filter transmitting the transmission band signal and attenuating the receiving band signal so as to transmit a transmission frequency band signal in the forward direction and absorb and attenuate the transmission frequency band signal by a resistor therein while transmitting a reception frequency band signal in the reverse direction. With this, the non-reciprocal circuit element is capable of being inserted between an antenna and a transmission and reception branch circuit element (duplexer, circulator, surface acoustic wave element, or the like). That is to say, transmission waves reflected by the antenna are significantly reduced or prevented from coming around to the receiving side.

According to various preferred embodiments of the present invention, a preferable isolation characteristic is obtained over a wide band, and also is capable of being used for a transmission and reception circuit unit.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 1A and 1B illustrate equivalent circuits of a non-reciprocal circuit element in a basic mode, wherein FIG. 1A illustrates a first basic example and FIG. 1B illustrates a second basic example.

FIGS. 5A and 5B illustrate outer appearances of the non-reciprocal circuit elements according to the first preferred embodiment of the present invention, wherein FIG. 5A is a first example and FIG. 5B is a second example.

FIGS. 11A and 11B are equivalent circuit diagrams illustrating a non-reciprocal circuit element according to a second preferred embodiment of the present invention, wherein FIG. 11A illustrates a basic mode and FIG. 11B illustrates an application mode.

FIGS. 14A and 14B are equivalent circuit diagrams illustrating a non-reciprocal circuit element according to a third preferred embodiment of the present invention, wherein FIG. 14A illustrates a basic mode and FIG. 14B illustrates an application mode.

DETAILED DESCRIPTION OF THE PREFERRED EMBODIMENTS

Figure 1A:
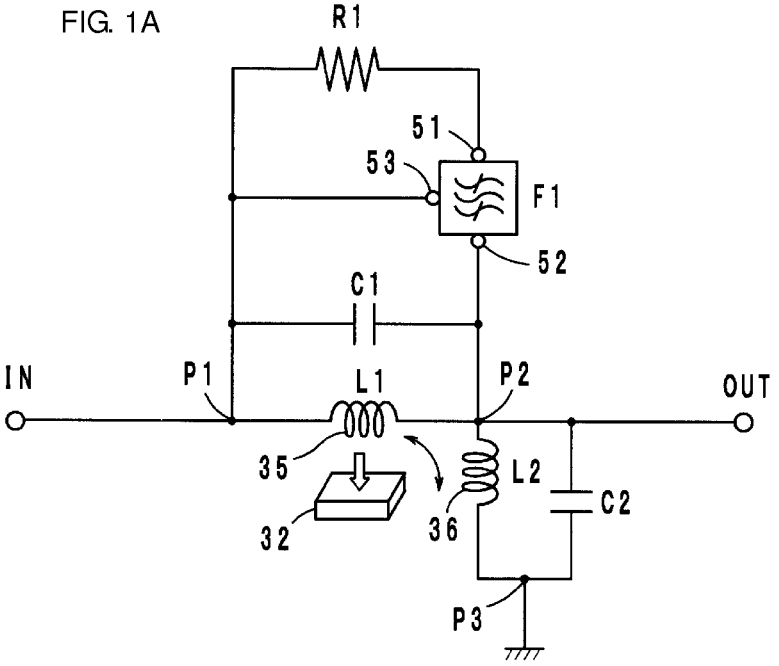

Hereinafter, preferred embodiments of a non-reciprocal circuit element, a module thereof, and a transmission and reception module according to the present invention are described with reference to the accompanying drawings. Common reference numerals denote the same members and elements in the respective drawings and overlapped description thereof is omitted.

FIG. 1A illustrates a first basic example of the non-reciprocal circuit element. In the non-reciprocal circuit element, a first center electrode 35 configuring an inductor L1 and a second center electrode 36 configuring an inductor L2 are arranged on a ferrite 32 so as to intersect with and be insulated from each other. One end of the first center electrode 35 is assumed to be a first port P1 and the other end thereof is assumed to be a second port P2. One end of the second center electrode 36 is connected to the second port P2 and the other end thereof is connected to a ground port P3. A matching capacitor C1 and a resistor R1 that are connected in parallel with the first center electrode 35 are connected between the first port P1 and the second port P2. Further, a matching capacitor C2 is connected between the second port P2 and the ground port P3 so as to be in parallel with the second center electrode 36.

In addition, a filter (band pass filter) F1 is provided. The filter F1 includes input/output terminals 51 and 52 and a ground terminal 53. The input/output terminal 51 is connected to the resistor R1, the input/output terminal 52 is connected to the second port P2, and the ground terminal 53 is connected to the first port P1.

In the non-reciprocal circuit element having the above-mentioned circuit configuration, when a high-frequency current is input to the first port P1 from an external terminal IN (forward direction), the large high-frequency current flows through the second center electrode 36 while hardly flowing through the first center electrode 35. With this, the non-reciprocal circuit element operates with low insertion loss over a wide band. In the operating time, the high-frequency current also hardly flows through the resistor R1 and the filter F1, so that losses thereon can be neglected so as to prevent an increase in the insertion loss.

On the other hand, when a high-frequency signal is input to the second port P2 from an external terminal OUT (reverse direction), the signal is absorbed and attenuated by the resistor R1. The filter F1 having a wideband characteristic, which achieves matching between the first port P1 and second port P2 in the transmission band of the non-reciprocal circuit element, is used so as to provide a wideband reverse characteristic. When the non-reciprocal circuit element is arranged between a transmission and reception branch unit such as a duplexer and a power amplifier, an isolation characteristic is improved to be achieved over a wide band. With this, electric power in the reverse direction is not transmitted to the power amplifier side so as to stabilize operations of the power amplifier. Further, the non-reciprocal circuit element is configured to be used for a wideband or multiband transmission circuit unit having a wide operating band.

When the non-reciprocal circuit element is arranged between a transmission circuit or a reception circuit and an antenna, the filter F1 having characteristics that it transmits a transmission band signal and attenuates a receiving band signal is used so as to transmit a transmission frequency band signal in the forward direction and absorb and attenuate the transmission frequency band signal by the resistor R1 therein while transmitting a reception frequency band signal in the reverse direction.

Figure 1B:
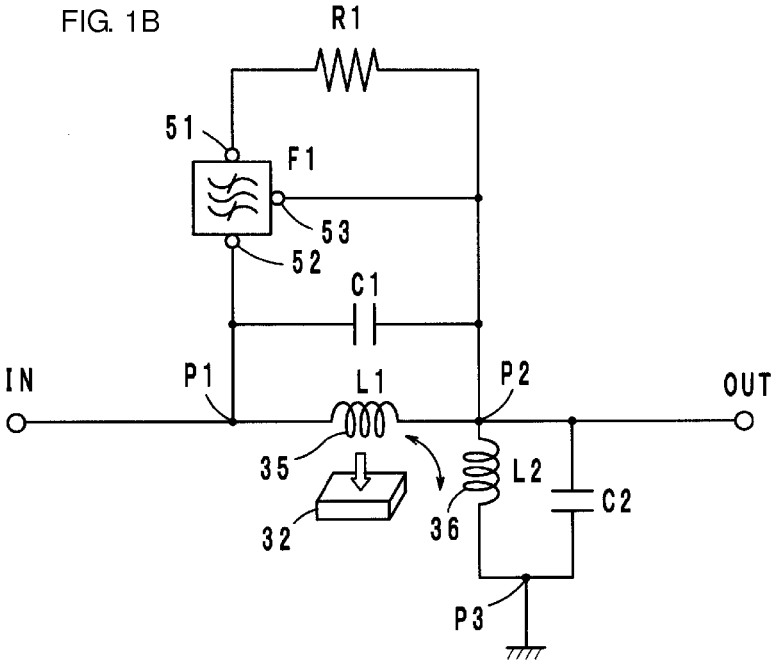

FIG. 1B illustrates a second basic example of the non-reciprocal circuit element. The input/output terminal 51 of the filter F1 is connected to the resistor R1, the input/output terminal 52 is connected to the first port P1, and the ground terminal 53 is connected to the second port P2. Other configurations in the second basic example are the same as those in the first basic example and action effects thereof are the same as those in the first basic example basically.

Figure 2:
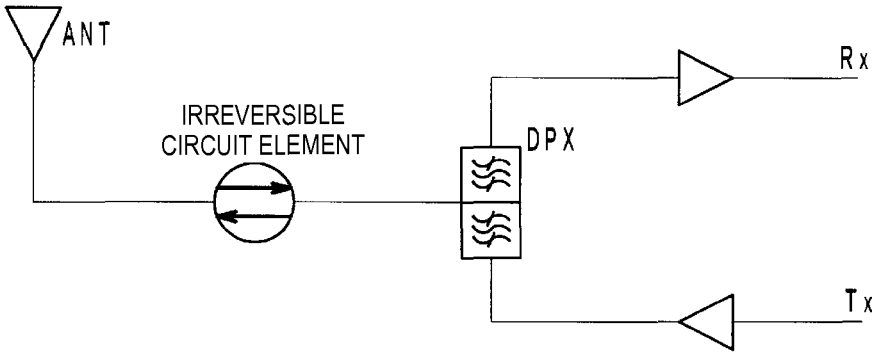
FIG. 2 is an equivalent circuit diagram illustrating a transmission and reception module.

As illustrated in FIG. 2, the non-reciprocal circuit element is capable of being inserted between an antenna ANT and a transmission and reception branch circuit element (duplexer DPX, or circulator, surface acoustic wave element, or the like (not illustrated)) so as to configure a transmission and reception circuit. In FIG. 2, Rx indicates a receiver in a relatively high frequency band and Tx indicates a transmitter in a relatively low frequency band. The transmission waves reflected by the antenna ANT are significantly reduced or prevented from coming around to the receiver Rx.

Figure 3:
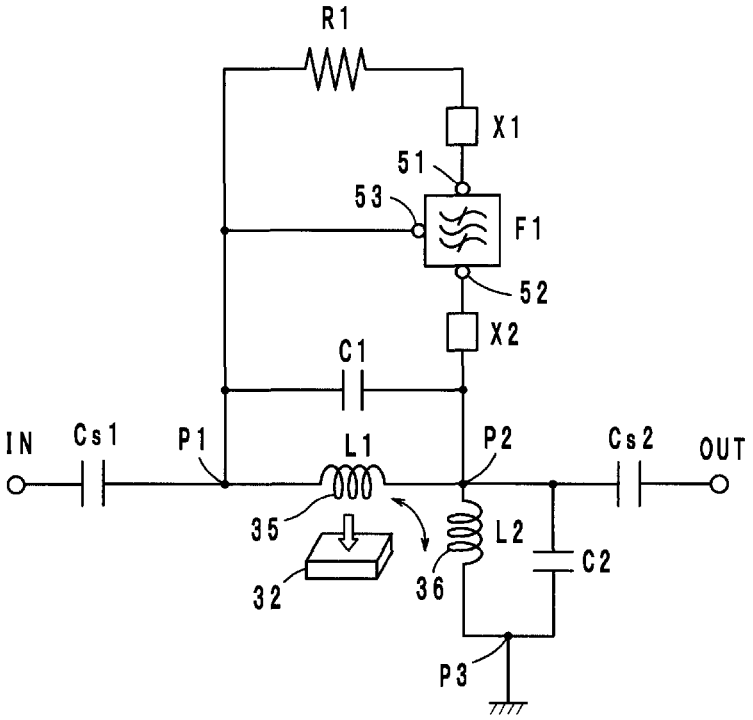
FIG. 3 is an equivalent circuit diagram illustrating a non-reciprocal circuit element according to a first preferred embodiment of the present invention.

As illustrated in the equivalent circuit in FIG. 3, the non-reciprocal circuit element according to a first preferred embodiment of the present invention has the circuit configuration of the first basic example basically. A reactance element X1 is connected between the input/output terminal 51 of the filter F1 and the resistor R1 and a reactance element X2 is connected between the input/output terminal 52 and the second port P2. Further, a matching capacitor Cs1 is connected between the first port P1 and the external terminal IN and a matching capacitor Cs2 is connected between the second port P2 and the external terminal OUT.

Figure 4:
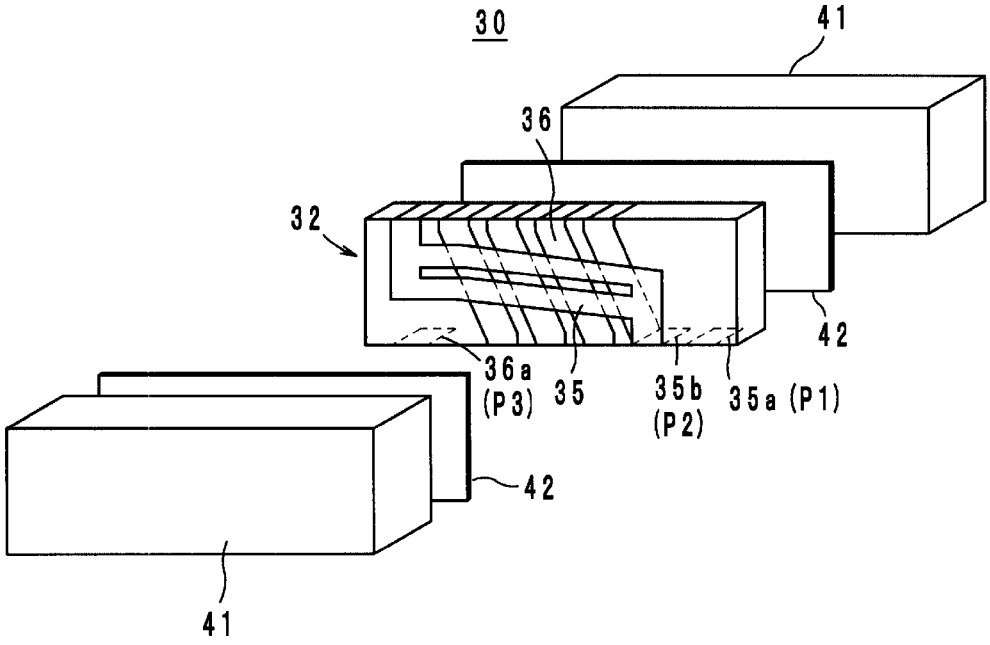
FIG. 4 is a perspective view illustrating a ferrite-magnet assembly configuring the non-reciprocal circuit element according to the first preferred embodiment of the present invention

The configuration of a main portion in the non-reciprocal circuit element as illustrated in FIG. 3 is described with reference to FIG. 4. The non-reciprocal circuit element includes a ferrite-magnet assembly 30 in which permanent magnets 41 are bonded to the front and rear surfaces of the ferrite 32 through adhesives 42. The first center electrode 35 is wound around the front and rear surfaces of the ferrite 32 by one turn, one end electrode 35*a* thereof corresponds to the first port P1 and the other end electrode 35*b* thereof corresponds to the second port P2. The second center electrode 36 is wound around the front and rear surfaces of the ferrite 32 preferably by four turns, for example, so as to intersect with the first center electrode 35 at a predetermined angle while keeping an insulation state. It should be noted that the number of windings thereof is arbitrary. One end of the second center electrode 36 is common to the electrode 35*b* (second port P2) and the other end electrode 36*a* of the second center electrode 36 is the third port P3. FIG. 4 omits illustration of electrodes at the rear surface side of the ferrite 32 in order to avoid complication.

Figure 5A:
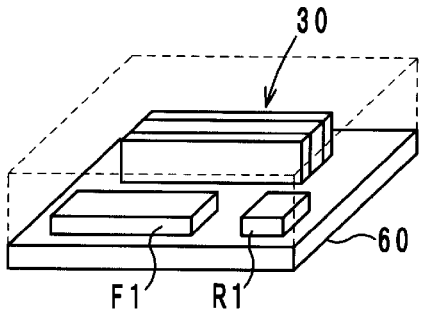

FIG. 5A illustrates a first example when the non-reciprocal circuit element is modularized. The ferrite-magnet assembly 30, the filter F1, and the chip-type resistor R1 are mounted on a base substrate 60 preferably made of a low temperature co-fired ceramics (LTCC) or a printed-circuit board (PCB). The base substrate 60 is a multilayered substrate and the elements such as the capacitors are incorporated in the multilayered base substrate 60.

Figure 5B:
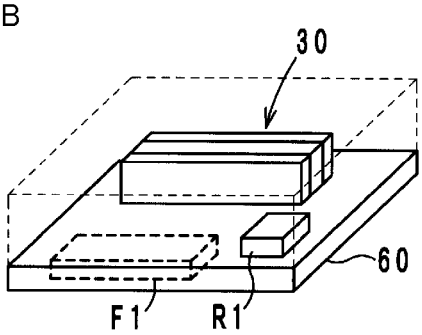

FIG. 5B illustrates a second example when the non-reciprocal circuit element is modularized. In this example, the filter F1 is also incorporated in the base substrate 60.

Figure 6:
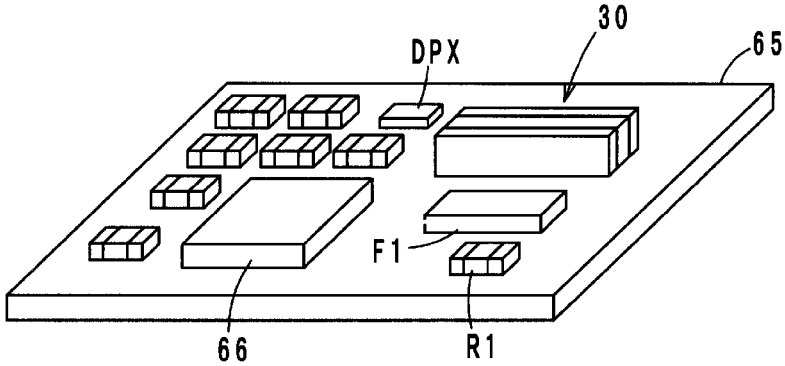
FIG. 6 is an outer perspective view illustrating an example of the transmission and reception module.

FIG. 6 illustrates a module formed by modularizing the transmission and reception circuit as illustrated in FIG. 2. A transmission/reception integrated circuit (IC) 66, a branch circuit element (duplexer DPX), various chip-type electronic elements, and the like in addition to the ferrite-magnet assembly 30, the filter F1, and the chip-type resistor R1 are mounted on a base substrate 65 formed by the LTCC or the PCB.

Figure 7:
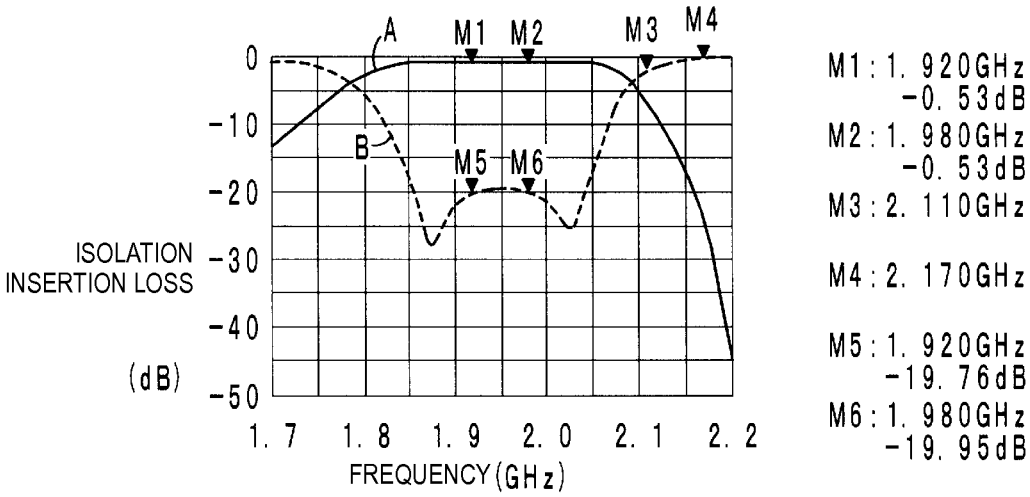
FIG. 7 is a graph illustrating characteristics of a first filter.
Figure 8:
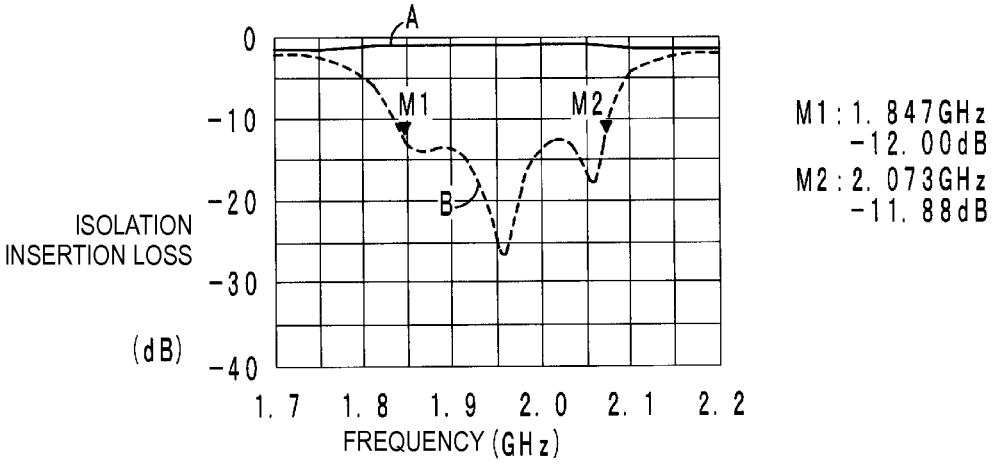
FIG. 8 is a graph illustrating characteristics of the non-reciprocal circuit element according to the first preferred embodiment of the present invention including the first filter.
Figure 19:
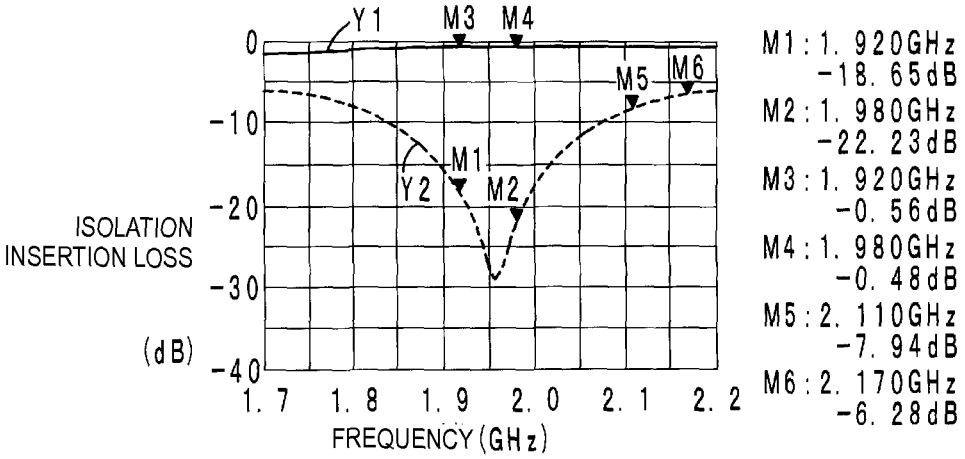
FIG. 19 PRIOR ART
FIG. 19 is a graph illustrating characteristics of the dual port-type isolator.

FIG. 8 illustrates first characteristics when a first filter having characteristics as illustrated in FIG. 7 is used as the filter F1 in the first preferred embodiment. The example characteristics as illustrated in FIG. 19 for comparison are obtained when the same values are set for elements other than those of the filter F1 and the reactance elements X1 and X2.

Inductor L1: about 7 nH
Inductor L2: about 17 nH
Capacitor C1: about 3.7 pF
Capacitor C2: about 1.8 pF
Capacitor Cs1: about 1.8 pF
Capacitor Cs2: about 2 pF
Resistor R1: about 50Ω
Reactance element X1: about 0 nH (direct coupling)
Reactance element X2: about 2 pF In FIG. 7 illustrating the characteristics of the first filter, a curved line A indicates the insertion loss characteristic and a curved line B indicates the reflection characteristic. The first characteristics of the non-reciprocal circuit element in this case are those as illustrated in FIG. 8; a curved line A indicates the insertion loss characteristic and a curved line B indicates the isolation characteristic. When a high-frequency signal is input in the reverse direction, impedance characteristics of a parallel resonance circuit configured by the filter F1 and the reactance elements X1 and X2 in addition to an LC parallel resonance circuit configured by the first center electrode 35 (inductor L1) and the capacitor C1 achieve wideband matching with the resistor R1 so as to improve the isolation characteristic. A band width with which the isolation of about −12 dB is ensured is about 173 MHz in the existing example in FIG. 19 whereas it is about 226 MHz when the first filter is used as show in FIG. 8.

On the other hand, when the high-frequency signal is input in the forward direction, the high-frequency signal hardly flows through the LC parallel resonance circuit. Therefore, deterioration in the insertion loss due to the LC parallel resonance circuit is negligible, thus providing a non-reciprocal circuit element with excellent characteristics.

Figure 9:
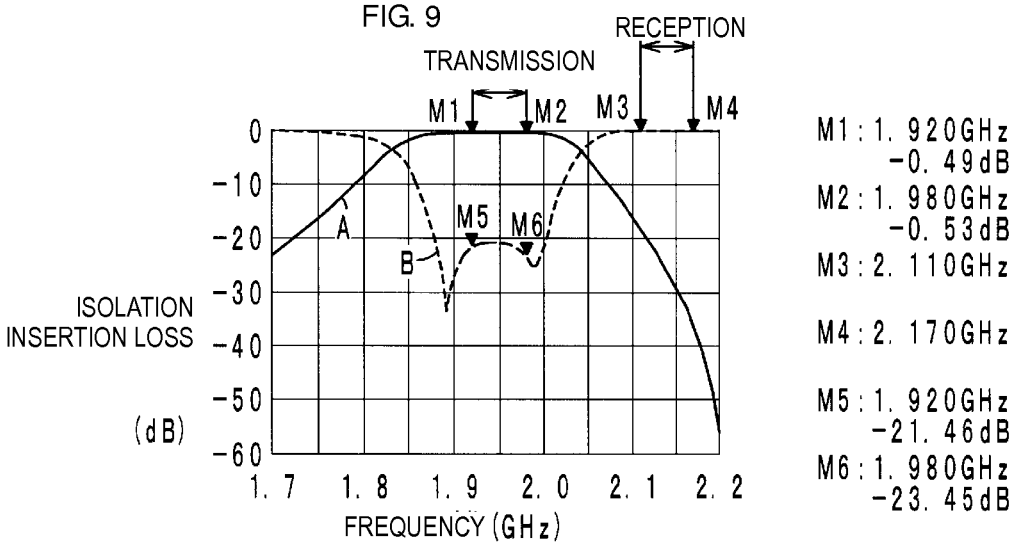
FIG. 9 is a graph illustrating characteristics of a second filter.
Figure 10:
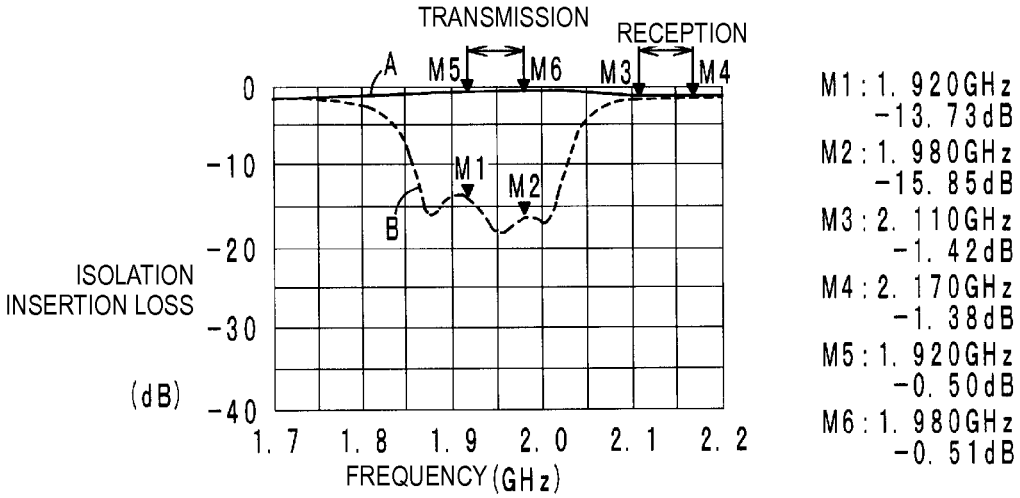
FIG. 10 is a graph illustrating characteristics of the non-reciprocal circuit element according to the first preferred embodiment of the present invention including the second filter.

FIG. 10 illustrates second characteristics when a second filter having characteristics as illustrated in FIG. 9 is used as the filter F1 in the first preferred embodiment. Numeral values other than that of the filter are those as illustrated in the first characteristics.

In FIG. 9 illustrating the characteristics of the second filter, a curved line A indicates the insertion loss characteristic and a curved line B indicates the isolation characteristic. That is to say, the second filter has a reflection characteristic of attenuating a transmission band signal (for example, about 1920 MHz to about 1980 MHz) and transmitting a receiving band signal (for example, about 2110 MHz to about 2170 MHz). The second characteristics of the non-reciprocal circuit element in this case are those as illustrated in FIG. 10; a curved line A indicates the insertion loss characteristic and a curved line B indicates the isolation characteristic. A transmission frequency band signal is made to transmit in the forward direction. The transmission frequency band signal is absorbed and attenuated by the resistor R1 whereas a reception frequency band signal is made to transmit in the reverse direction.

In the existing example in FIG. 19, the forward insertion loss in a band range of about 1920 MHz to about 1980 MHz is about −0.56 dB but it is improved to be about −0.51 dB in the second characteristics. Further, in the existing example, the reverse insertion loss in the band range of about 1920 MHz to about 1980 MHz is about −18.6 dB but it is decreased to about −13.73 dB in the second characteristics. However, the amount of change raises no problem for usage. In the existing example in FIG. 19, the reverse insertion loss in a band range of about 2110 MHz to about 2170 MHz is about −7.9 dB but it is improved to be about −1.42 dB in the second characteristics.

Antenna matching is generally unstable due to fluctuation in the impedance of the antenna in a mobile terminal. Due to this, reflection waves of the transmission waves transmitted by the antenna comes around to the receiving side, resulting in a problem. It is considered that an isolator is inserted between a duplexer and the antenna. However, the same antenna also receives signals, so that the existing isolator also absorbs the reception signals undesirably, resulting in significant deterioration in reception sensitivity. For this reason, the existing isolator cannot be arranged between the antenna and a transmission/reception branch point. In contrast, the non-reciprocal circuit element having the second characteristics is capable of being inserted between the antenna ANT and the duplexer DPX as illustrated in FIG. 2, thus reducing the transmission and reception module in size.

Figure 11A:
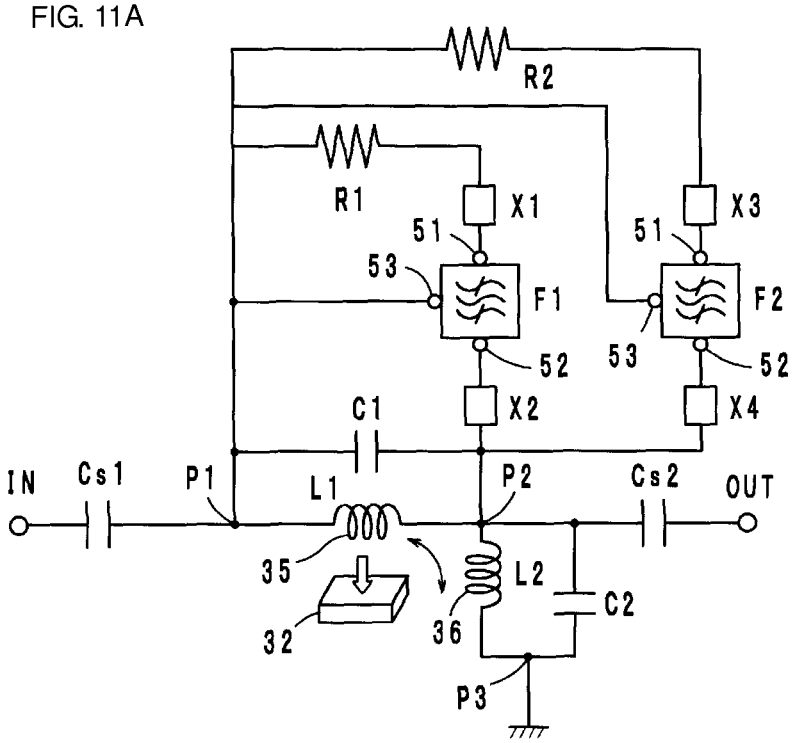

The non-reciprocal circuit element according to a second preferred embodiment, as illustrated in the equivalent circuit in FIG. 11A, a resistor R2 and a filter F2 are connected to each other in parallel with the resistor R1 and the filter F1 in the first preferred embodiment as illustrated in FIG. 3. Reactance elements X3 and X4 may be provided on the input/output terminals 51 and 52 of the filter F2.

Figure 11B:
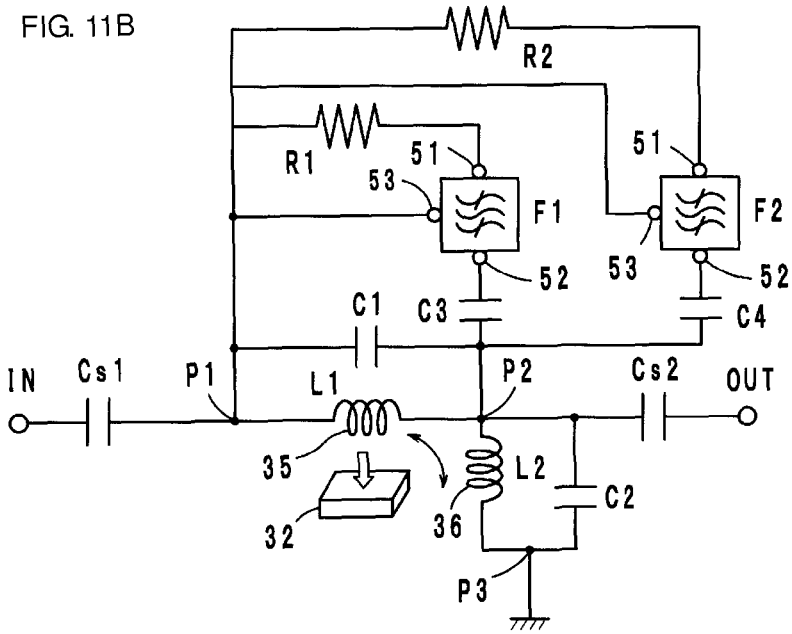
Figure 15:
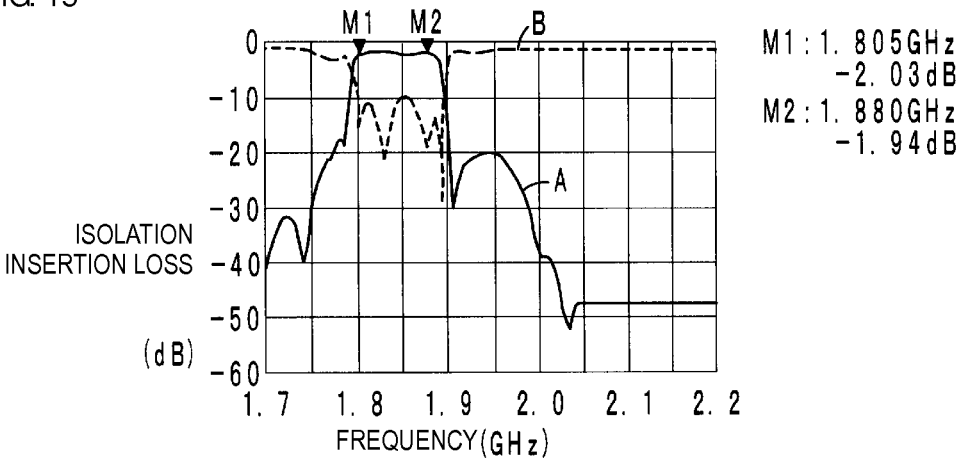
FIG. 15 is a graph illustrating characteristics of the third filter.
Figure 16:
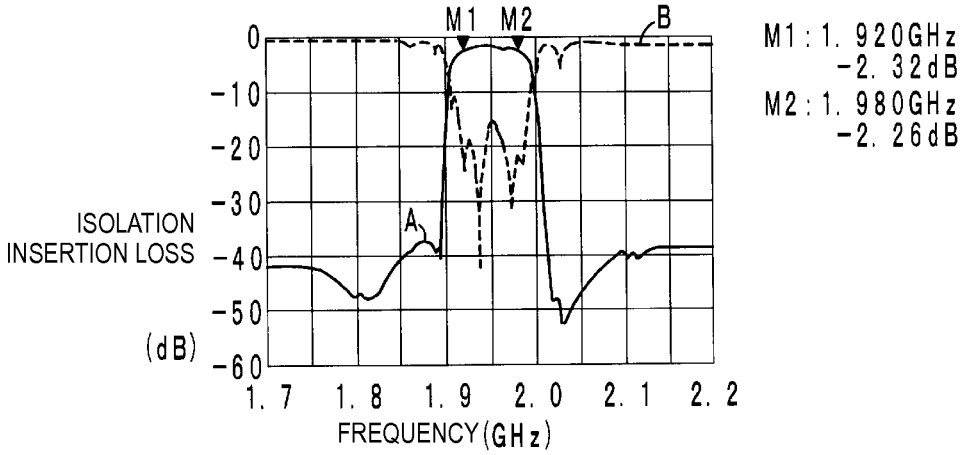
FIG. 16 is a graph illustrating characteristics of the fourth filter.
Figure 17:
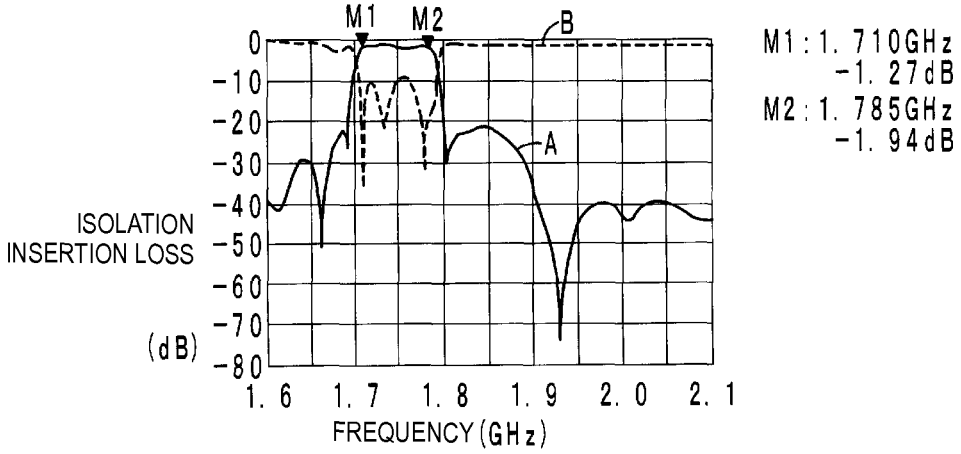
FIG. 17 is a graph illustrating characteristics of the fifth filter.
Figure 18:
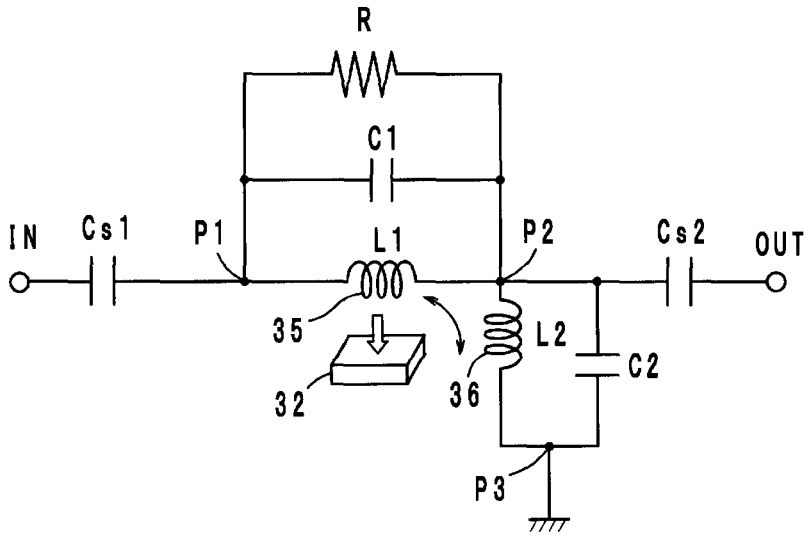
FIG. 18 PRIOR ART
FIG. 18 is an equivalent circuit diagram illustrating a dual port-type isolator in an existing technique.

To be more specific, as illustrated in FIG. 11B, a capacitor C3 preferably is used as the reactance element X2 and a capacitor C4 preferably is used as the reactance element X4 and characteristics were simulated. Filters used for the simulation of the characteristics are a third filter having characteristics as illustrated in FIG. 15, a fourth filter having characteristics as illustrated in FIG. 16, and a fifth filter having characteristics as illustrated in FIG. 17. In each of FIG. 15, FIG. 16, and FIG. 17, a curved line A indicates the insertion loss characteristic and a curved line B indicates the isolation characteristic.

Figure 12:
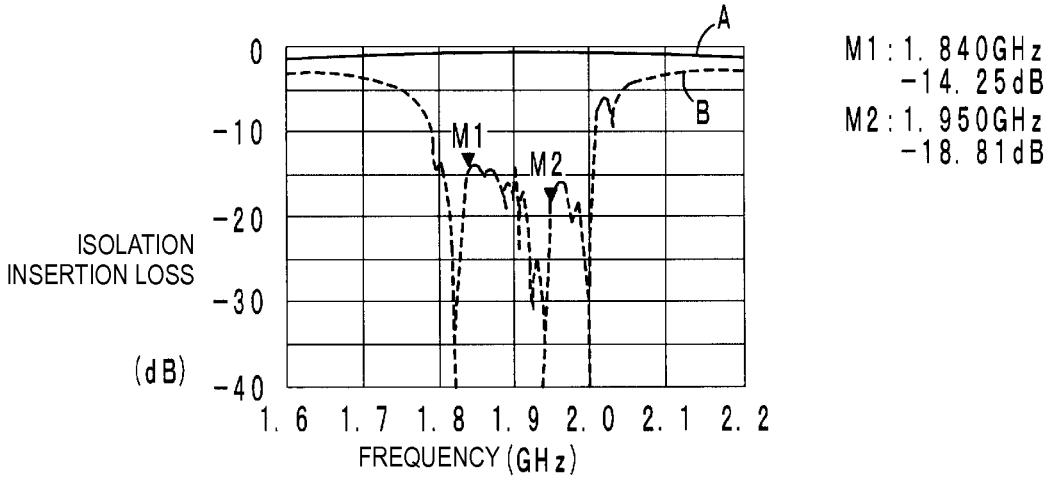
FIG. 12 is a graph illustrating characteristics of the non-reciprocal circuit element according to the first preferred embodiment of the present invention including a third filter and a fourth filter.

Third characteristics of the non-reciprocal circuit element when the third filter as illustrated in FIG. 15 is used as the filter F1 and the fourth filter as illustrated in FIG. 16 is used as the filter F2 are those as illustrated in FIG. 12. In FIG. 12, a curved line A indicates the insertion loss characteristic and a curved line B indicates the isolation characteristic. The third characteristics use elements of the following exemplary numerical values.

Inductor L1: about 7 nH
Inductor L2: about 17 nH
Capacitor C1: about 3.2 pF
Capacitor C2: about 1.8 pF
Capacitor Cs1: about 1.8 pF
Capacitor Cs2: about 2 pF
Resistor R1: about 50Ω
Resistor R2: about 50Ω
Capacitor C3: about 1.5 pF
Capacitor C4: about 1.4 pF The third filter is a band pass filter, and a cutoff frequency thereof at the low-frequency side and a cutoff frequency thereof at the high-frequency side are about 1805 MHz and about 1880 MHz, respectively, for example. The fourth filter is band pass filter, and a cutoff frequency thereof at the low-frequency side and a cutoff frequency thereof at the high-frequency side are about 1920 MHz and about 1980 MHz, respectively, for example. The center frequency of the transmission band of the third filter is lower than the center frequency of the transmission band of the fourth filter. A difference between the cutoff frequency of the third filter at the high-frequency side and the cutoff frequency of the fourth filter at the low-frequency side is about 40 MHz and they are close to each other on a frequency axis.

In this manner, a plurality of filters of which cutoff frequency at the high-frequency side and cutoff frequency at the low-frequency side are close to each other on the frequency axis are capable of being used so as to achieve the wideband reverse characteristic of the non-reciprocal circuit element. As illustrated in FIG. 12, the non-reciprocal circuit element in the second preferred embodiment has the isolation characteristic of equal to or lower than about −10 dB over a wide frequency band of about 1840 MHz to about 1950 MHz, for example.

The above-mentioned configuration in which the plurality of filters are used is useful when there are a plurality of predetermined frequency bands to be used in transmission and they are close to each other on the frequency axis, and one filter cannot cover the entire transmission band.

Figure 13:
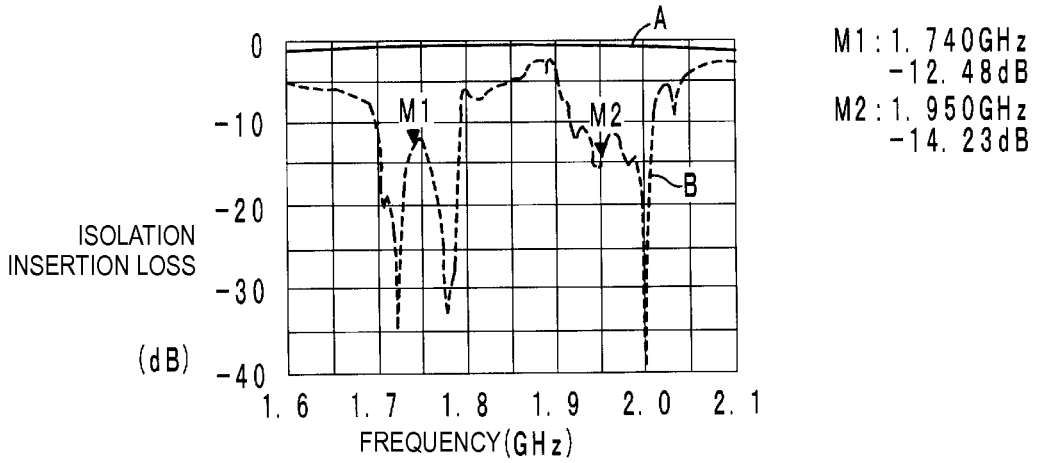
FIG. 13 is a graph illustrating characteristics of the non-reciprocal circuit element according to the second preferred embodiment of the present invention including the fourth filter and a fifth filter.

Fourth characteristics of the non-reciprocal circuit element when the fourth filter as illustrated in FIG. 16 is used as the filter F1 and the fifth filter as illustrated in FIG. 17 is used as the filter F2 are those as illustrated in FIG. 13. In FIG. 13, a curved line A indicates the insertion loss characteristic and a curved line B indicates the isolation characteristic.

The fifth filter is a band pass filter, and a cutoff frequency thereof at the low-frequency side and a cutoff frequency thereof at the high-frequency side are about 1710 MHz and about 1785 MHz, respectively, for example. The center frequency of the transmission band of the fifth filter is lower than the center frequency of the transmission band of the fourth filter. A difference between the cutoff frequency of the fifth filter at the high-frequency side and the cutoff frequency of the fourth filter at the low-frequency side is about 140 MHz, for example, and they are separated from each other on the frequency axis.

In this manner, the plurality of filters of which cutoff frequency thereof at the high-frequency side and cutoff frequency thereof at the low-frequency side are separated from each other on the frequency axis are used, so that even when there are a plurality of predetermined frequency bands to be used in transmission and they are separated from each other on the frequency axis, one non-reciprocal circuit element is capable of managing them. As illustrated in FIG. 13, the non-reciprocal circuit element according to the second preferred embodiment has the isolation characteristic of equal to or lower than about −10 dB in the two separated frequency bands on the frequency axis of about 1710 MHz to about 1785 MHz and about 1920 MHz to about 1980 MHz, for example.

Figure 14A:
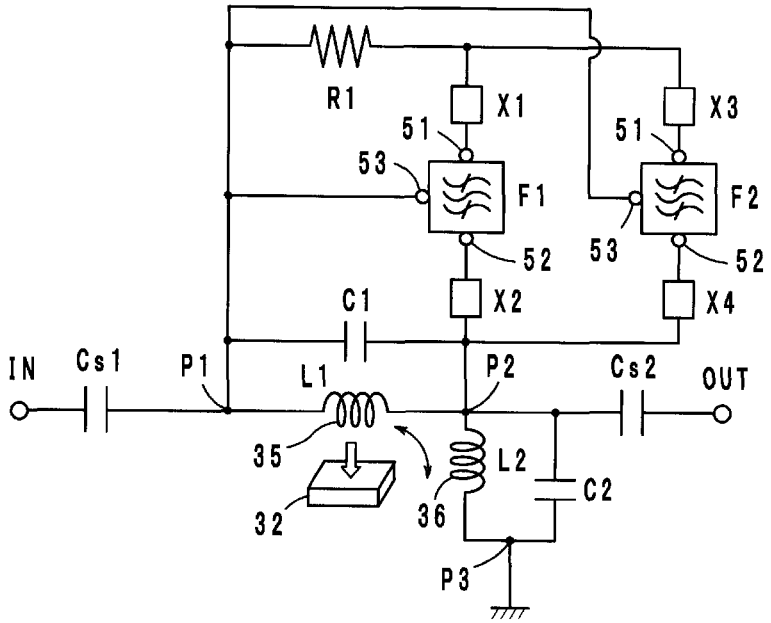

As illustrated in the equivalent circuit in FIG. 14A, the non-reciprocal circuit element according to a third preferred embodiment of the present invention preferably is formed by connecting the filter F2 to the filter F1 in parallel in the first preferred embodiment as illustrated in FIG. 3. The reactance elements X3 and X4 may be provided on the input/output terminals 51 and 52 of the filter F2, respectively.

Figure 14B:
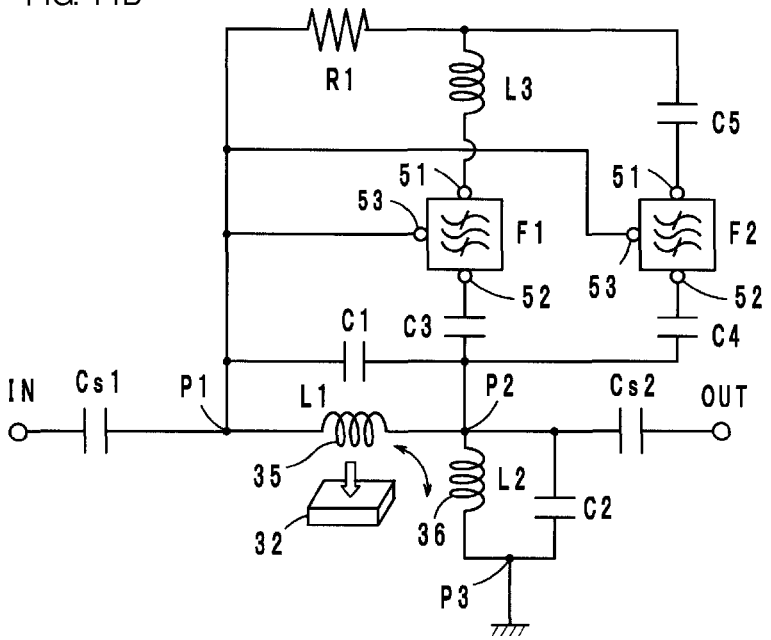

To be more specific, as illustrated in FIG. 14B, an inductor L3 is used as the reactance element X1, the capacitor C3 is used as the reactance element X2, a capacitor C5 is used as the reactance element X3, and the capacitor C4 is used as the reactance element X4. The third filter as illustrated in FIG. 15, the fourth filter as illustrated in FIG. 16, and the fifth filter as illustrated in FIG. 17 is capable of being used selectively as in the second preferred embodiment.

Even when the configuration in the third preferred embodiment is used, the same effects as those obtained in the second preferred embodiment are obtained. The configuration in the third preferred embodiment is appropriately selected in accordance with the size of a mounting board and design in the layout of the non-reciprocal circuit element.

The non-reciprocal circuit element, the module thereof, and the transmission and reception module according to the present invention are not limited to those in the above-described preferred embodiments and can be variously changed in a range of the scope of the present invention.

For example, when an N pole and an S pole of each permanent magnet 41 are inversed, the input port P1 and the output port P2 are switched. Further, the shapes of the first and second center electrodes 35 and 36 are arbitrary.

As described above, various preferred embodiments of the present invention are useful in non-reciprocal circuit elements, modules thereof, and transmission and reception modules. In particular, preferred embodiments of the present invention are excellent because they provide preferable isolation characteristic over a wide band and are configured to be used in the transmission/reception circuit unit.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A non-reciprocal circuit element comprising:

a permanent magnet;

a ferrite to which a direct current magnetic field is applied by the permanent magnet; and a first center electrode and a second center electrode that are arranged on the ferrite so as to intersect with and be insulated from each other; wherein one end of the first center electrode is connected to a first port and the other end of the first center electrode is connected to a second port;

one end of the second center electrode is connected to the second port and the other end of the second center electrode is connected to a ground port;

a first capacitor and a resistor that are connected to each other in parallel are connected between the first port and the second port;

a second capacitor is connected between the second port and the ground port;

an input/output terminal of at least one filter is connected between the first port or the second port and the resistor;

a ground terminal of the at least one filter is connected to the second port or the first port; and the at least one filter is configured to transmit a transmission band signal and attenuate a receiving band signal, or the at least one filter is configured to achieve matching between the first port and the second port in a transmission band of the non-reciprocal circuit element.

2. The non-reciprocal circuit element according to claim 1, wherein the at least one filter has a reflection characteristic of attenuating a transmission band signal and transmitting a receiving band signal.

3. The non-reciprocal circuit element according to claim 1, wherein the at least one filter includes a plurality of filters; and a cutoff frequency of a filter having a lower center frequency among the plurality of filters at a high-frequency side and a cutoff frequency of a filter having a higher center frequency among the plurality of filters at a low-frequency side are close to each other.

4. The non-reciprocal circuit element according to claim 1, wherein the at least one filter includes a plurality of filters; and a cutoff frequency of a filter having a lower center frequency among the plurality of filters at a high-frequency side and a cutoff frequency of a filter having a higher center frequency among the plurality of filters at a low-frequency side are separated from each other.

5. The non-reciprocal circuit element according to claim 1, further comprising a matching capacitor connected to the first port.

6. The non-reciprocal circuit element according to claim 1, further comprising a matching capacitor connected to the second port.

7. A transmission and reception module comprising:

a substrate;

the non-reciprocal circuit element according to claim 1; and a branch circuit element configured to branch a transmission signal and a reception signal; wherein the non-reciprocal circuit element and the branch circuit element are mounted on the substrate.

8. The non-reciprocal circuit element according to claim 1, further comprising a plurality of reactance elements connected to the input/output terminal of the at least one filter.

9. The non-reciprocal circuit element according to claim 8, wherein each of the plurality of reactance elements includes a capacitor.

10. A non-reciprocal circuit element module comprising:

a substrate; and the non-reciprocal circuit element according to claim 1 mounted on the substrate.

11. The non-reciprocal circuit element module according to claim 10, wherein the substrate is a multilayered substrate, and the at least one filter is incorporated in the multilayered substrate.

12. The non-reciprocal circuit element according to claim 1, wherein a reactance element is connected to the input/output terminal of the at least one filter.

13. The non-reciprocal circuit element according to claim 12, wherein the reactance element includes a capacitor.

14. The non-reciprocal circuit element according to claim 12, wherein the reactance element includes an inductor.

* * * * *